US011367382B2

(12) United States Patent
Wang et al.

(10) Patent No.: US 11,367,382 B2
(45) Date of Patent: Jun. 21, 2022

(54) DISPLAY DEVICE DRIVING METHOD

(71) Applicant: Shenzhen China Star Optoelectronics Semiconductor Display Technology Co., Ltd., Shenzhen (CN)

(72) Inventors: Zeng Wang, Shenzhen (CN); Pengfei Liang, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 322 days.

(21) Appl. No.: 16/620,514

(22) PCT Filed: Sep. 11, 2019

(86) PCT No.: PCT/CN2019/105467
§ 371 (c)(1),
(2) Date: Dec. 8, 2019

(87) PCT Pub. No.: WO2021/035809
PCT Pub. Date: Mar. 4, 2021

(65) Prior Publication Data

US 2021/0358391 A1 Nov. 18, 2021

(30) Foreign Application Priority Data

Aug. 28, 2019 (CN) ..... 201910803978.4

(51) Int. Cl.
*G09G 3/32* (2016.01)

(52) U.S. Cl.
CPC ..... *G09G 3/32* (2013.01); *G09G 2300/0452* (2013.01); *G09G 2320/0247* (2013.01)

(58) Field of Classification Search
CPC ..... G09G 3/32; G09G 2300/0452; G09G 2320/0247; G09G 3/3225; G09G 3/2029; G09G 3/204; G09G 2320/0266; G09G 3/3233
See application file for complete search history.

(56) References Cited

U.S. PATENT DOCUMENTS 7,589,700 B2 * 9/2009 Miyagawa ..... G09G 3/3258 345/77
8,305,404 B2 * 11/2012 Hosaka ..... G09G 3/3674 345/691
2009/0002295 A1 * 1/2009 Hosaka ..... G09G 3/3685 345/87

* cited by examiner

*Primary Examiner* — Vijay Shankar

(57) ABSTRACT

The present invention provides a method of driving a display device, comprising the steps of: step S1, providing a display device, comprising a plurality of sub-pixels arranged in an array; step S2: dividing data signals of the sub-pixels in a frame of an image into a plurality of sub-frames having different time weights; step S3, dividing the plurality of sub-pixels into at least two driving groups, and the plurality of sub-frames corresponding to the sub-pixels in different driving groups having different display order; and step S4, driving each of the sub-pixels to display image according to a display order of one of the sub-frames corresponding to each of the sub-pixels, such that through setting different display order of sub-frames of the sub-pixels of different driving groups, the flicker caused by the digital driving can be reduced without increasing driving frequency.

9 Claims, 4 Drawing Sheets

DISPLAY DEVICE DRIVING METHOD

RELATED APPLICATIONS

This application is a National Phase of PCT Patent Application No. PCT/CN2019/105467 having International filing date of Sep. 11, 2019, which claims the benefit of priority of Chinese Patent Application No. 201910803978.4 filed on Aug. 28, 2019. The contents of the above applications are all incorporated by reference as if fully set forth herein in their entirety.

FIELD AND BACKGROUND OF THE INVENTION

The present invention relates to a field of display technologies, and in particular, to a method of driving a display device.

With the development of display technology, self-luminous display devices, such as an organic light-emitting diode (OLED) display device, a mini light-emitting diode (mini-LED) display device, and a micro light-emitting diode (micro-LED), have become more and more popular and are recognized by the industry as the most promising display devices.

The above self-luminous display device has a plurality of pixels arranged in an array, and light-emitting unit is driven to emit light by a pixel drive circuit. As shown in FIG. 1, a common pixel driving circuit includes a switching thin film transistor T10, a driving thin film transistor T20, a storage capacitor C10, and a light-emitting unit D. The driving methods include an analog driving method and a digital driving method. When the analog driving method is adopted, since the driving thin film transistor T20 is operated in a saturation region for a long time, its threshold voltage (Vth) will drift, resulting in uneven brightness of a panel display image, which impacts the display effect. The light-emitting unit D can be an OLED, a mini-LED, or a micro-LED depending on requirements.

$$I_{ds,sat}=k*(V_{gs}-Vth)^2=k*(V_A-V_B-Vth)^2$$

In the digital driving method of the self-luminous display device, a gate of the driving thin film transistor T20 outputs only two gamma voltage levels, respectively:

the highest gamma level (GM1) that makes the organic light-emitting diode the brightest and the lowest gamma level (GM9) that makes the light-emitting unit the darkest, complying with a transistor current voltage IV equation:

$$I_{ds,sat}=k*(V_{gs}-Vth)^2=k*(V_A-V_B-Vth)^2$$

wherein, $I_{ds,sat}$ is a transistor conduction current, k is an intrinsic conduction factor, $V_{gs}$ is a gate-source voltage of the driving thin film transistor T20, Vth is a threshold voltage of the driving thin film transistor T20, VA is a gate voltage of the driving thin film transistor T20, and VB is a source voltage of the driving thin film transistor T20.

As shown in FIG. 2, in the digital driving method in which sub-frames are divided non-equally, a normal frame is cut into a plurality of sub-frames (SFs), and time weights of the sub-frames are driven in accordance with 1:1/2:1/4:1/8:1/16:1/32:1/64:1/128, and a pulse width modulation (PWM) brightness signal is adjusted by controlling the brightness of the sub-frames, and combined with the time integration principle of brightness of human perception, digital voltage (GM1 and GM9) can be used to display images having different grayscale brightness, but this method is prone to flicker problems during display, and is especially noticeable when it is in low grayscale. In order to solve the above-mentioned flicker problem, the prior art will use a grayscale scattering method to split the original low-weight sub-frames into several smaller sub-frames and insert them between other sub-frames to avoid flickering. However, if a number of sub-frames is increased, a hardware driving frequency needs to be increased, and in actual application, hardware implementation is difficult and costly.

SUMMARY OF THE INVENTION

An object of the present invention is to provide a method of driving a display device capable of reducing flicker caused by digital driving without increasing a channel frequency, thereby improving display quality and product competitiveness.

To achieve the above object, the present invention provides a method of driving a display device, including the following steps:

step S1, providing a display device, including a plurality of sub-pixels arranged in an array;

step S2: dividing data signals of the sub-pixels in a frame of an image into a plurality of sub-frames having different time weights;

step S3, dividing the plurality of sub-pixels into at least two driving groups, and the plurality of sub-frames corresponding to the sub-pixels in different driving groups having different display order; and step S4, driving each of the sub-pixels to display image according to a display order of one of the sub-frames corresponding to each of the sub-pixels.

In the step S2, the plurality of sub-pixels are divided into two groups, the sub-pixels in odd-numbered rows belong to a first group, and the sub-pixels in even-numbered rows belong to a second group.

In the step S2, the data signals of the sub-pixels in the frame of the image are divided into four sub-frames having the different time weights, which respectively include a first sub-frame, a second sub-frame, a third sub-frame, and a fourth sub-frame, and the time weights of the first sub-frame, the second sub-frame, the third sub-frame, and the fourth sub-frame are sequentially increased; in the step S4, the sub-pixels in the odd-numbered rows are sequentially displayed in an order of the first sub-frame, the second sub-frame, the third sub-frame, and the fourth sub-frame; and the sub-pixels in the even-numbered rows are sequentially displayed in an order of the fourth sub-frame, the second sub-frame, the first sub-frame, and the third sub-frame.

In the step S1, the sub-pixels in each of the rows are provided with their corresponding ones of scanning lines, and the sub-pixels in each of the rows are electrically connected to the corresponding ones of the scanning lines.

The plurality of sub-pixels include first sub-pixels, second sub-pixels, and third sub-pixels, each having a color different from another, and in the sub-pixels of a same row, the first sub-pixel, the second sub-pixel, and the third sub-pixel are repeatedly arranged in sequence, and the sub-pixels of a same column have a same color.

The plurality of sub-pixels are divided into four groups in the step S2, wherein the sub-pixels in odd-numbered rows of odd-numbered columns are a first group, the sub-pixels in the odd-numbered rows of even-numbered columns are a second group, the sub-pixels of even-numbered rows of the odd-numbered columns are a third group, and the sub-pixels of even-numbered rows of the even-numbered columns are a second group, the sub-pixels of the even-numbered rows of the odd-numbered columns are a third group, and the sub-pixels of the even-numbered rows of the even-numbered columns are a fourth group.

In the step S2, the data signals of the sub-pixels in the frame of the image are divided into four sub-frames having the different time weights, respectively including a first sub-frame, a second sub-frame, a third sub-frame, and a fourth sub-frame, and the time weights of the first sub-frame, the second sub-frame, the third sub-frame, and the fourth sub-frame are sequentially increased; in the step S4, the sub-pixels in the even-numbered rows of the even-numbered columns are sequentially displayed in an order of the first sub-frame, the second sub-frame, the third sub-frame, and the fourth sub-frame; the sub-pixels in the odd-numbered rows of the even-numbered columns are sequentially displayed in an order of the second sub-frame, the first sub-frame, the third sub-frame, and the fourth sub-frame; the sub-pixels in the even-numbered rows of the odd-numbered columns are sequentially displayed in an order of the fourth sub-frame, the second sub-frame, the first sub-frame, and the third sub-frame; and the sub-pixels in the even-numbered rows of the even-numbered columns are sequentially displayed in an order of the third sub-frame, the fourth sub-frame, the first sub-frame, and the second sub-frame.

In the step S1, the sub-pixels in each of the rows are provided with their corresponding twos of scanning lines, and in the sub-pixels in same one of the rows, the sub-pixels of the odd-numbered columns are connected to one of the scanning lines, while the sub-pixels of even-numbered columns are connected to another one of the scanning lines.

The plurality of sub-pixels include first sub-pixels, second sub-pixels, and third sub-pixels, each having a color different from another, wherein the sub-pixels of the odd-numbered rows of the odd-numbered columns are the first sub-pixels, the sub-pixels of the odd-numbered rows of the even-numbered columns are the second sub-pixels, the sub-pixels of the even-numbered rows of the odd-numbered columns are the third sub-pixels, and the sub-pixels of the even-numbered rows of the even-numbered columns are the fourth sub-pixels.

The display device is an OLED display device, a mini-LED display device, or a micro-LED display device.

An advantageous effect of the present invention is that the present invention provides a method of driving a display device, including the steps of: step S1, providing a display device, including a plurality of sub-pixels arranged in an array; step S2: dividing data signals of the sub-pixels in a frame of an image into a plurality of sub-frames having different time weights; step S3, dividing the plurality of sub-pixels into at least two driving groups, and the plurality of sub-frames corresponding to the sub-pixels in different driving groups having different display order; and step S4, driving each of the sub-pixels to display image according to a display order of one of the sub-frames corresponding to each of the sub-pixels, such that through setting different display order of sub-frames of the sub-pixels of different driving groups, the flicker caused by the digital driving can be reduced without increasing driving frequency.

BRIEF DESCRIPTION OF THE SEVERAL VIEWS OF THE DRAWINGS

In order to more clearly illustrate the embodiments or the technical solutions of the existing art, the drawings illustrating the embodiments or the existing art will be briefly described below. Obviously, the drawings in the following description merely illustrate some embodiments of the present invention. Other drawings may also be obtained by those skilled in the art according to these figures without paying creative work.

In the drawings.

DESCRIPTION OF SPECIFIC EMBODIMENTS OF THE INVENTION

In order to further clarify the technical means and effects of the present invention, the following detailed description will be made in conjunction with the preferred embodiments and the accompanying drawings of the present invention.

Figure 7:
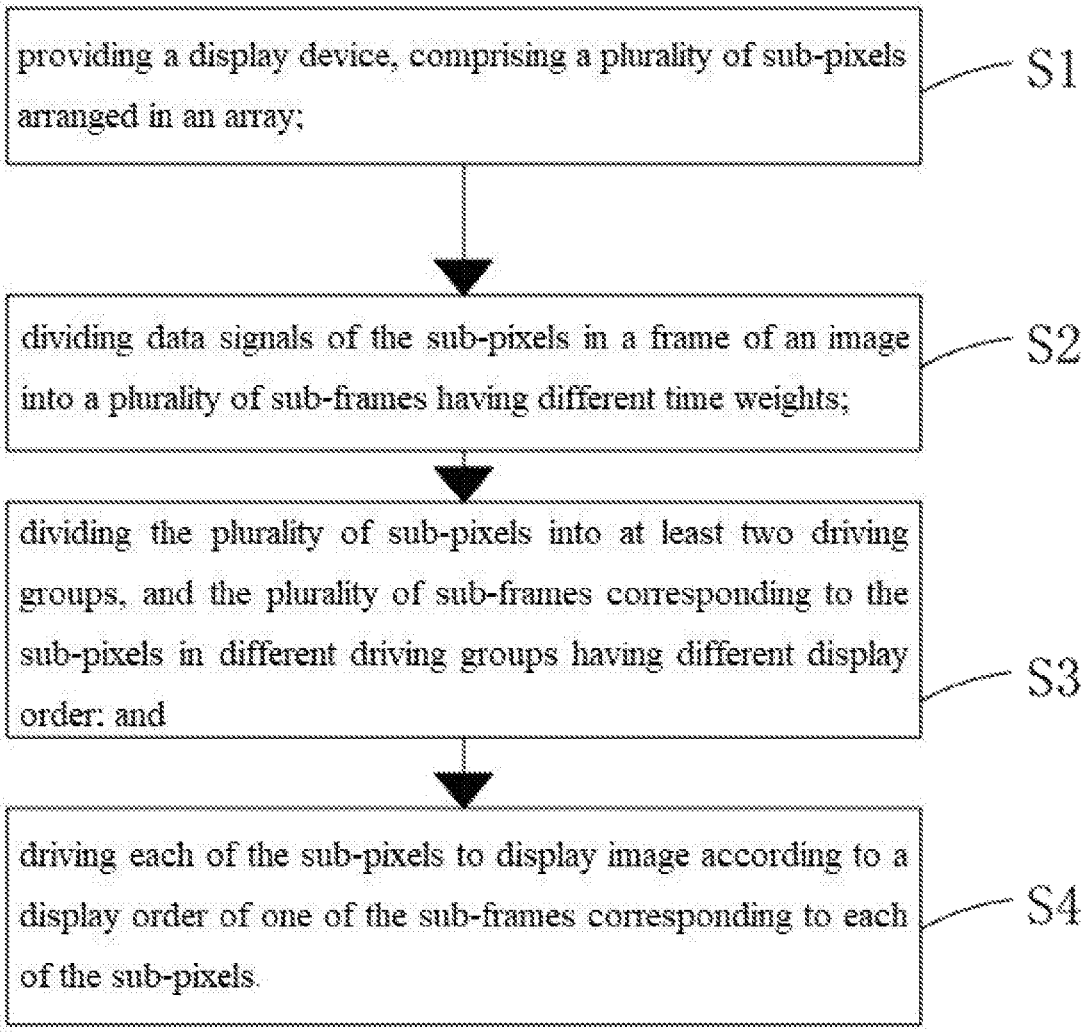
FIG. 7 is a flow chart showing a method of driving the display device of the present invention.

Referring to FIG. 7, the present invention provides a method of driving a display device, including the following steps:

step S1, providing a display device, including a plurality of sub-pixels 10 arranged in an array;

step S2: dividing data signals of the sub-pixels 10 in a frame of an image into a plurality of sub-frames having different time weights;

step S3, dividing the plurality of sub-pixels 10 into at least two driving groups, and the plurality of sub-frames corresponding to the sub-pixels 10 in different driving groups having different display order; and step S4, driving each of the sub-pixels to display image according to a display order of one of the sub-frames corresponding to each of the sub-pixels 10.

Figure 1:
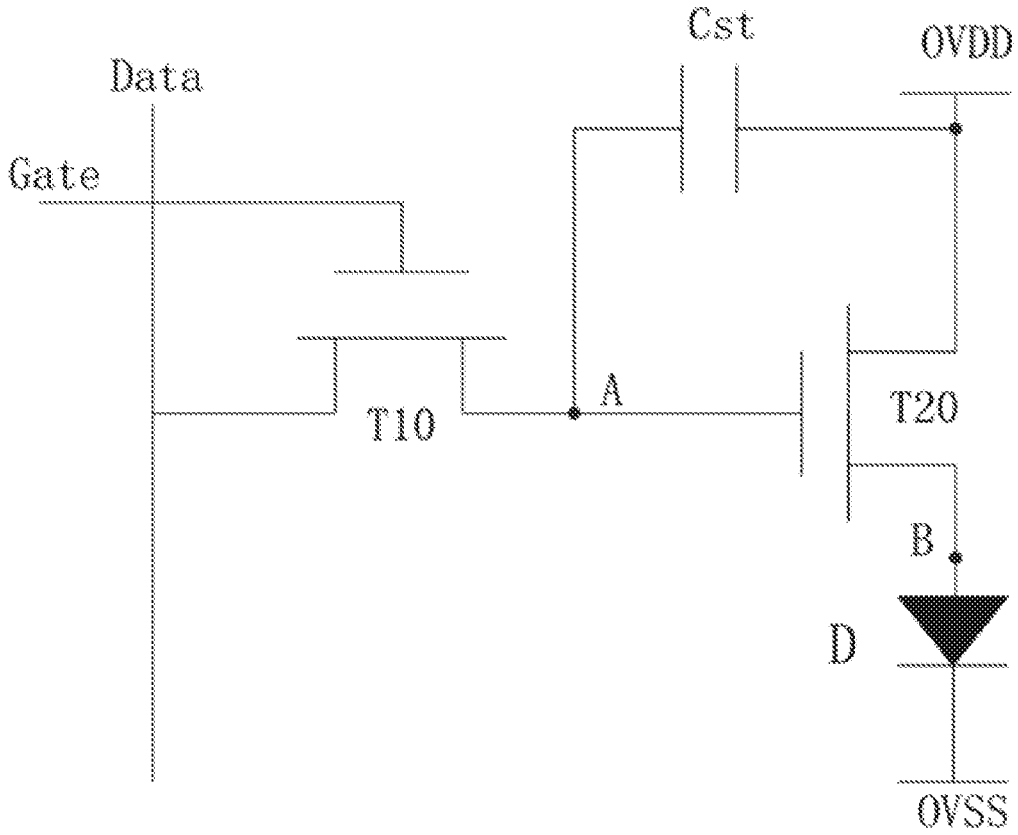
FIG. 1 is a circuit diagram of a conventional pixel driving circuit.
Figure 2:
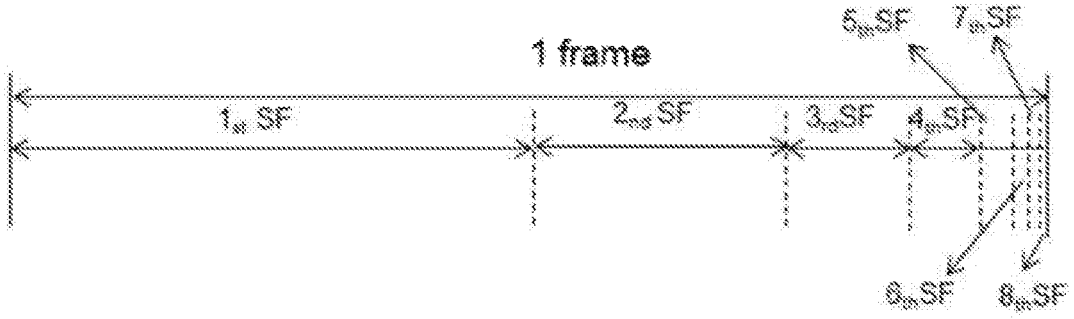
FIG. 2 is a schematic diagram of a conventional non-equally-divided sub-frame driving method.
Figure 3:
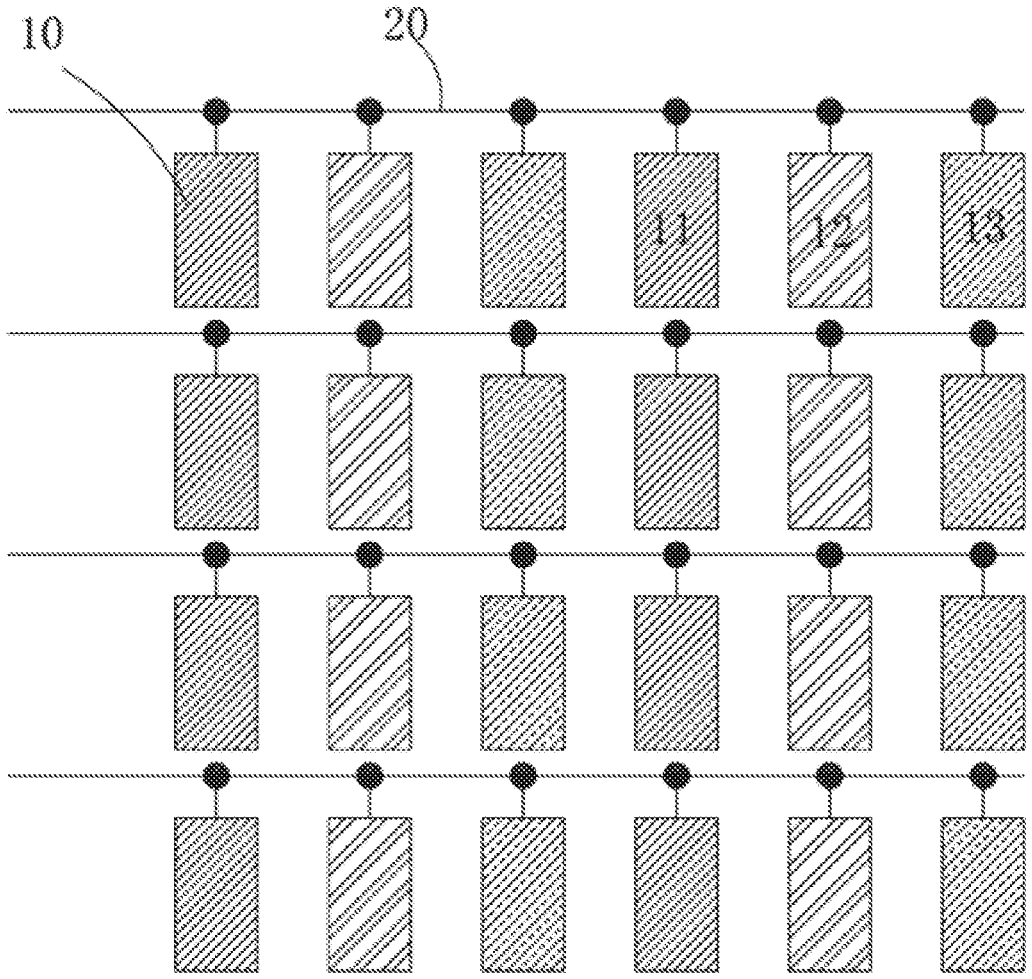
FIG. 3 is a schematic diagram of the step S1 of the first embodiment of the method of driving the display device of the present invention.
Figure 4:
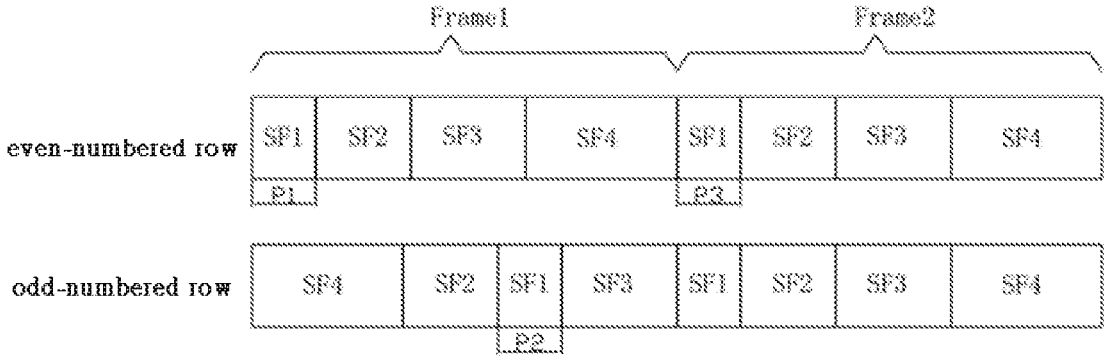
FIG. 4 is a schematic diagram of the step S4 of the first embodiment of the method of driving the display device of the present invention.

Specifically, referring to FIG. 3 in conjunction with FIG. 4, in the first embodiment of the present invention, the plurality of sub-pixels 10 are divided into two groups in the step S2, wherein the sub-pixels 10 of the even-numbered rows are the first group, and the sub-pixels 10 of the odd-numbered rows are the second group.

Further, as shown in FIG. 4, in the first embodiment of the present invention, in the step S2, the data signals of the sub-pixels 10 in the frame of the image are divided into four sub-frames having the different time weights, which respectively include a first sub-frame SF1, a second sub-frame SF2, a third sub-frame SF3, and a fourth sub-frame SF4, and the time weights of the first sub-frame SF1, the second sub-frame SF2, the third sub-frame SF3, and the fourth sub-frame SF4 are sequentially increased.

Preferably, a ratio of the time weights of the first sub-frame SF1, the second sub-frame SF2, the third sub-frame SF3, and the fourth sub-frame SF4 is 1:2:4:8, respectively, which is of course not a limitation of the present invention, and the specific ratio can be selected according to actual needs.

As shown in FIG. 4, in the step S4, the sub-pixels 10 in the odd-numbered rows are sequentially displayed in an order of the first sub-frame SF1, the second sub-frame SF2, the third sub-frame SF3, and the fourth sub-frame SF4; and the sub-pixels 10 in the even-numbered rows are sequentially displayed in an order of the fourth sub-frame SF4, the second sub-frame SF2, the first sub-frame SF1, and the third sub-frame SF3.

Specifically, in the step S1, the sub-pixels 10 in each of the rows are provided with their corresponding ones of scanning lines 20, and the sub-pixels 10 in each of the rows are electrically connected to the corresponding ones of the scanning lines 20. The plurality of sub-pixels 10 include first sub-pixels 11, second sub-pixels 12, and third sub-pixels 13, each having a color different from another, and in the sub-pixels 10 of a same row, the first sub-pixel 11, the second sub-pixel 12, and the third sub-pixel 13 are repeatedly arranged in sequence, and the sub-pixels 10 of a same column have a same color.

Preferably, the first sub-pixel 11, the second sub-pixel 12, and the third sub-pixel 13 are red, green, and blue sub-pixels, respectively.

For example, in the first embodiment of the present invention, in the Frame 1, the sub-pixels 10 of the first row are sequentially displayed in an order of the first sub-frame SF1, the second sub-frame SF2, the third sub-frame SF3, and the fourth sub-frames SF4, and the sub-pixels 10 of the second row are sequentially displayed in an order of the fourth sub-frame SF4, the second sub-frame SF2, the first sub-frame SF1, and the third sub-frame SF3. Taking the first sub-pixels 11 as an example, in the P1 stage, the first sub-pixels 11 of the first row of the first column emit light; in the P2 phase, the first sub-pixels 11 of the second row of the first column emit light; and in the P3 phase, the first sub-pixels 11 of the first row of the first column emit light. The first sub-pixels 11 of the first row of the first column and the first sub-pixel 11 of the second row of the first column are close to each other, which cannot be clearly recognized by human eyes, so it will be considered that a same position emits light, such that the flicker problem of the digital driving can be effectively solved without adding more sub-frames, and only the sub-frame display order needs to be changed, which does not lead to an increase in the driving frequency, and the product quality is improved without increasing the cost.

Figure 5:
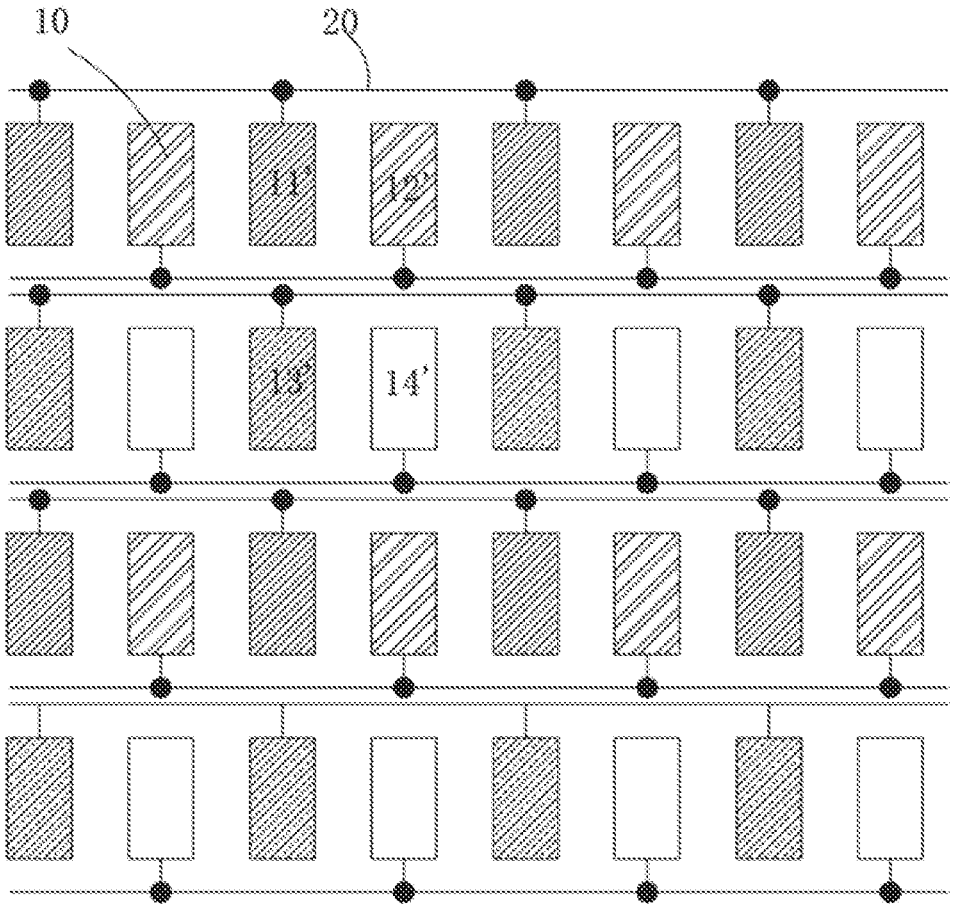
FIG. 5 is a schematic diagram of the step S1 of the second embodiment of the method of driving the display device of the present invention.
Figure 6:
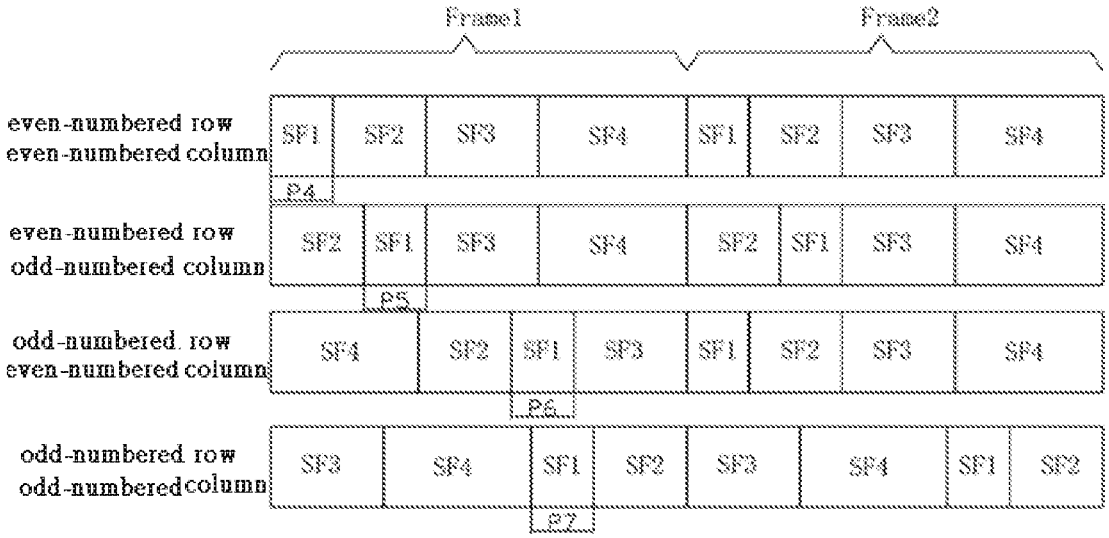
FIG. 6 is a schematic diagram of the step S4 of the second embodiment of the method of driving the display device of the present invention.

Specifically, referring to FIG. 5 and FIG. 6, in the second embodiment of the present invention, the plurality of sub-pixels 10 are divided into four groups in the step S2, wherein the sub-pixels 10 of the odd-numbered rows of the odd-numbered columns are the first group, sub-pixels 10 of the odd-numbered rows of the even-numbered columns are the second group, the sub-pixels 10 of the even-numbered rows of the odd-numbered columns are the third group, and the sub-pixels 10 of the even-numbered rows of the even-numbered columns are the fourth group.

In the step S2, the data signals of the sub-pixels 10 in one frame are divided into four sub-frames having different time weights, which are a first sub-frame SF1, a second sub-frame SF2, a third sub-frame SF3, and a fourth sub-frame SF4, and the time weights of the first sub-frame SF1, the second sub-frame SF2, the third sub-frame SF3, and the fourth sub-frame SF4 are sequentially increased.

Preferably, a ratio of the time weights of the first sub-frame SF1, the second sub-frame SF2, the third sub-frame SF3, and the fourth sub-frame SF4 is 1:2:4:8, respectively, which is of course not a limitation of the present invention, and the specific ratio can be selected according to actual needs.

When driving, in the step S4, the sub-pixels 10 of the odd-numbered rows of the odd-numbered columns are sequentially displayed in the order of the first sub-frame SF1, the second sub-frame SF2, the third sub-frame SF3, and the fourth sub-frame SF4;

the sub-pixels 10 of the odd-numbered rows of the even-numbered columns are sequentially displayed in an order of the second sub-frame SF2, the first sub-frame SF1, the third sub-frame SF3, and the fourth sub-frame SF4;

the sub-pixels 10 of the even-numbered rows of the odd-numbered columns are sequentially displayed in an order of the fourth sub-frame SF4, the second sub-frame SF2, the first sub-frame SF1, and the third sub-frame SF3; and the sub-pixels 10 of the even-numbered rows of the even-numbered columns are sequentially displayed in an order of the third sub-frame SF3, the fourth sub-frame SF4, the first sub-frame SF1, and the second sub-frame SF2.

Further, as shown in FIG. 3, in the step S1, the sub-pixels 10 in each of the rows are provided with their corresponding twos of scanning lines 20, and in the sub-pixels 10 in same one of the rows, the sub-pixels 10 of the odd-numbered columns are connected to one of the scanning lines 20, while the sub-pixels 10 of even-numbered columns are connected to another one of the scanning lines 20. The plurality of sub-pixels include first sub-pixels 11', second sub-pixels 12', third sub-pixels 13', and fourth sub-pixels 14', each having a color different from another, wherein the sub-pixels 10 of the odd-numbered rows of the odd-numbered columns are the first sub-pixels 11', the sub-pixels 10 of the odd-numbered rows of the even-numbered columns are the second sub-pixels 12', the sub-pixels 10 of the even-numbered rows of the odd-numbered columns are the third sub-pixels 13', and the sub-pixels 10 of the even-numbered rows of the even-numbered columns are the fourth sub-pixels 14'.

Preferably, the first sub-pixel 11', the second sub-pixel 12', the third sub-pixel 13', and the fourth sub-pixel 14' display red, green, blue, and white colors, respectively.

As shown in FIG. 6, in the P4 to P7 stages, the sub-pixels 10 of the odd-numbered rows of the odd-numbered columns, the sub-pixels 10 of the odd-numbered rows of the even-numbered columns, the sub-pixels 10 of the even-numbered rows of the odd-numbered columns, and the sub-pixels 10 of the even-numbered rows of the even-numbered columns emit light, respectively. The four spatially staggered and adjacent sub-pixels 10 emit light in the P4 to P7 stages, respectively, thereby replacing the existing gray scale scattering with the spatial scattering, effectively solving the digital driving flicker problem without adding more sub-frames, which can be realized only by changing the display order of the sub-frames, without causing an increase in the driving frequency, and the product quality is improved without increasing the cost.

It should be noted that the display device of the present invention may be a self-luminous display device such as an OLED display device, a mini-LED display device, or a micro-LED display device, depending on actual needs.

Further, although only the case of four sub-frames is illustrated in the first and second embodiments of the present invention, the present invention is not strictly limited to a specific number of sub-frames, and driving methods of other numbers of the sub-frames, such as six or eight sub-frames can also applicable to the present invention, and for the driving method of the four sub-frames, the display order of each of the sub-frames may also be the display in an order other than that in the above first or second embodiments, which may be selected and optimized according to requirements of the actual application, and it does not impact implementation of the present invention.

Therefore, the present invention can replace the existing gray-scale scattering with the spatial scattering, and can solve the flicker problem of digital driving without increasing the driving frequency, thereby improving product quality and competitiveness.

In summary, the present invention provides a method of driving a display device, including the steps of: step S1, providing a display device, including a plurality of sub-pixels arranged in an array; step S2: dividing data signals of the sub-pixels in a frame of an image into a plurality of sub-frames having different time weights; step S3, dividing the plurality of sub-pixels into at least two driving groups, and the plurality of sub-frames corresponding to the sub-pixels in different driving groups having different display order; and step S4, driving each of the sub-pixels to display image according to a display order of one of the sub-frames corresponding to each of the sub-pixels, such that through setting different display order of sub-frames of the sub-pixels of different driving groups, the flicker caused by the digital driving can be reduced without increasing driving frequency.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A method of driving a display device, comprising the steps of:

step S1, providing a display device comprising a plurality of sub-pixels arranged in an array;

step S2: dividing data signals of the sub-pixels in a frame of an image into a plurality of sub-frames having different time weights;

step S3, dividing the plurality of sub-pixels into at least two driving groups, and the plurality of sub-frames corresponding to the sub-pixels in different driving groups having different display order; and step S4, driving each of the sub-pixels to display image according to a display order of one of the sub-frames corresponding to each of the sub-pixels, wherein in the step S2, the plurality of sub-pixels are divided into two groups, the sub-pixels in odd-numbered rows belong to a first group, and the sub-pixels in even-numbered rows belong to a second group;

in the step S2, the data signals of the sub-pixels in the frame of the image are divided into four sub-frames having the different time weights, which respectively comprise a first sub-frame, a second sub-frame, a third sub-frame, and a fourth sub-frame, and the time weights of the first sub-frame, the second sub-frame, the third sub-frame, and the fourth sub-frame are sequentially increased;

in the step S4, the sub-pixels in the odd-numbered rows are sequentially displayed in an order of the first sub-frame, the second sub-frame, the third sub-frame, and the fourth sub-frame; and the sub-pixels in the even-numbered rows are sequentially displayed in an order of the fourth sub-frame, the second sub-frame, the first sub-frame, and the third sub-frame.

2. The method of driving the display device according to claim 1, wherein in the step S1, the sub-pixels in each of the rows are provided with their corresponding ones of scanning lines, and the sub-pixels in each of the rows are electrically connected to the corresponding ones of the scanning lines.

3. The method of driving the display device according to claim 1, wherein the plurality of sub-pixels comprise first sub-pixels, second sub-pixels, and third sub-pixels, each having a color different from another, and in the sub-pixels of a same row, the first sub-pixel, the second sub-pixel, and the third sub-pixel are repeatedly arranged in sequence, and the sub-pixels of a same column have a same color.

4. The method of driving a display device according to claim 1, wherein the display device is an organic light-emitting diode (OLED) display device, a mini light-emitting diode (mini-LED) display device, or a micro light-emitting diode (micro-LED) display device.

5. A method of driving a display device, comprising the steps of:

step S1, providing a display device comprising a plurality of sub-pixels arranged in an array;

step S2: dividing data signals of the sub-pixels in a frame of an image into a plurality of sub-frames having different time weights;

step S3, dividing the plurality of sub-pixels into at least two driving groups, and the plurality of sub-frames corresponding to the sub-pixels in different driving groups having different display order; and step S4, driving each of the sub-pixels to display image according to a display order of one of the sub-frames corresponding to each of the sub-pixels, wherein the plurality of sub-pixels are divided into four groups in the step S2, wherein the sub-pixels in odd-numbered rows of odd-numbered columns are a first group, the sub-pixels in the odd-numbered rows of even-numbered columns are a second group, the sub-pixels of even-numbered rows of the odd-numbered columns are a third group, and the sub-pixels of the even-numbered rows of the even-numbered columns are a fourth group.

6. The method of driving the display device according to claim 5, wherein in the step S2, the data signals of the sub-pixels in the frame of the image are divided into four sub-frames having the different time weights, respectively comprising a first sub-frame, a second sub-frame, a third sub-frame, and a fourth sub-frame, and the time weights of the first sub-frame, the second sub-frame, the third sub-frame, and the fourth sub-frame are sequentially increased;

in the step S4, the sub-pixels in the even-numbered rows of the even-numbered columns are sequentially displayed in an order of the first sub-frame, the second sub-frame, the third sub-frame, and the fourth sub-frame;

the sub-pixels in the odd-numbered rows of the even-numbered columns are sequentially displayed in an order of the second sub-frame, the first sub-frame, the third sub-frame, and the fourth sub-frame;

the sub-pixels in the even-numbered rows of the odd-numbered columns are sequentially displayed in an order of the fourth sub-frame, the second sub-frame, the first sub-frame, and the third sub-frame; and the sub-pixels in the even-numbered rows of the even-numbered columns are sequentially displayed in an order of the third sub-frame, the fourth sub-frame, the first sub-frame, and the second sub-frame.

7. The method of driving the display device according to claim 5, wherein in the step S1, the sub-pixels in each of the rows are provided with their corresponding twos of scanning lines, and in the sub-pixels in same one of the rows, the sub-pixels of the odd-numbered columns are connected to one of the scanning lines, while the sub-pixels of even-numbered columns are connected to another one of the scanning lines.

8. The method of driving a display device according to claim 5, wherein the plurality of sub-pixels comprise first sub-pixels, second sub-pixels, and third sub-pixels, each having a color different from another, wherein the sub-pixels of the odd-numbered rows of the odd-numbered columns are the first sub-pixels, the sub-pixels of the odd-numbered rows of the even-numbered columns are the second sub-pixels, the sub-pixels of the even-numbered rows of the odd-numbered columns are the third sub-pixels, and the sub-pixels of the even-numbered rows of the even-numbered columns are the fourth sub-pixels.

9. The method of driving a display device according to claim 5, wherein the display device is an organic light-emitting diode (OLED) display device, a mini light-emitting diode (mini-LED) display device, or a micro light-emitting diode (micro-LED) display device.

* * * * *